US006591532B1

(12) United States Patent
Gilbertson et al.

(10) Patent No.: US 6,591,532 B1
(45) Date of Patent: Jul. 15, 2003

(54) GUN EJECTION PORT LOCK

(75) Inventors: Mark Gilbertson, Sauk City, WI (US); Edward Raleigh, Waunakee, WI (US); Charles Russell, Oconomowoc, WI (US)

(73) Assignee: Product Source LLC, Waunakee, WI (US)

( * ) Notice: Subject to any disclaimer, the term of this patent is extended or adjusted under 35 U.S.C. 154(b) by 0 days.

(21) Appl. No.: 10/144,474

(22) Filed: May 13, 2002

Related U.S. Application Data

(60) Provisional application No. 60/290,825, filed on May 14, 2001.

(51) Int. Cl.[7] ..... F41A 17/44
(52) U.S. Cl. ..... 42/70.11
(58) Field of Search ..... 42/70.11, 96

(56) References Cited

U.S. PATENT DOCUMENTS

| | | | | | |
|---|---|---|---|---|---|
| 2,997,802 | A | * | 8/1961 | Robbins | 42/70.11 |
| 3,089,272 | A | | 5/1963 | McKinlay | |
| 3,378,943 | A | * | 4/1968 | Valburg | 42/70.11 |
| 3,634,963 | A | | 1/1972 | Hermann | |
| 4,266,356 | A | * | 5/1981 | Jarvinen Uro T. | 42/70.11 |
| 4,896,447 | A | | 1/1990 | Badoni | |
| 5,231,236 | A | * | 7/1993 | Del Real et al. | 42/70.11 |
| 5,241,769 | A | | 9/1993 | Von Muller | |
| 5,331,759 | A | | 7/1994 | Marceau et al. | |
| 5,419,069 | A | | 5/1995 | Mumbleau et al. | |
| 5,465,519 | A | * | 11/1995 | Blanck | 42/70.11 |
| 5,669,252 | A | | 9/1997 | Bentley | |
| 6,226,914 | B1 | * | 5/2001 | Reed | 42/70.11 |
| 6,499,244 | B1 | * | 12/2002 | Smith et al. | 42/70.11 |

FOREIGN PATENT DOCUMENTS

| | | | | |
|---|---|---|---|---|
| WO | WO 9210714 A1 | * | 6/1992 | F41A/17/02 |

* cited by examiner

*Primary Examiner*—Charles T. Jordan
*Assistant Examiner*—John W. Zerr
(74) *Attorney, Agent, or Firm*—Craig A. Fieschko, Esq.; DeWitt Ross & Stevens S.C.

(57) ABSTRACT

An ejection port gun lock includes an elongated body and a slide member which is slidably affixed to the body to move along a slide path (with the slide path being oriented generally parallel to the length of the body) between an engaged position within a gun ejection port and a disengaged position in the ejection port. A locking member is provided on the body adjacent to the slide path, and the locking member is movable between a locked position wherein it extends into the slide path to engage the slide member, and an unlocked position allowing motion of the slide member.

47 Claims, 6 Drawing Sheets

GUN EJECTION PORT LOCK

CROSS-REFERENCE TO RELATED APPLICATIONS

This application claims priority under 35 USC §119(e) to U.S. Provisional Patent Application Serial No. 60/290,825 filed May 14, 2001, the entirety of which is incorporated by reference herein.

FIELD OF THE INVENTION

This disclosure concerns an invention relating generally to safety devices for preventing unauthorized and/or accidental discharge of firearms, and more specifically to ejection port locks for shotguns, handguns, and the like.

BACKGROUND OF THE INVENTION

For safety purposes, it is generally desirable for handguns, shotguns, and other firearms to be stored in a secured area, such as a gun locker or safe, to prevent unauthorized use by children or others. However, since secured areas can sometimes be breached (as when children locate hidden locker keys), and firearms may become accessible to unintended users when they are removed from secured areas for use (e.g., immediately before or after hunting trips and the like), alternative means of preventing unauthorized discharge of firearms have been developed, such as trigger locks. However, trigger locks have limited effectiveness because they often don't fit particular models of firearms well unless the locks are specifically made for the models in question. Additionally, it is possible for some loaded firearms to accidentally discharge even when a trigger lock is present. Therefore, it would be useful to have available alternative forms of preventing unauthorized discharge of firearms, particularly if such apparata are readily adaptable to fit a wide variety of firearms having different sizes and configurations.

SUMMARY OF THE INVENTION

The invention involves a gun lock which engages the ejection port of a firearm to prevent unauthorized use. To give the reader a basic understanding of some of the advantageous features of the invention, following is a brief summary of preferred versions of the ejection port gun lock. As this is merely a summary, it should be understood that more details regarding the preferred versions may be found in the Detailed Description set forth elsewhere in this document. The claims set forth at the end of this document then define the various versions of the invention in which exclusive rights are secured.

The ejection port gun lock includes an elongated body which extends between a front surface and a rear surface, with the length of the body between the front and rear surfaces extending along the length of the gun when the gun lock is in use. A slide member is slidably affixed to the body to move along a slide path between an engaged position and a disengaged position (with the slide path being oriented generally parallel to the length of the body), and the slide member includes an elongated engagement portion which extends generally parallel to the slide path. When the slide member rests within a gun ejection port in the engaged position, the engagement portion engages the gun so that the body cannot be removed therefrom, whereas the gun lock is removable when the slide member is in the disengaged position. A locking member is provided on the body adjacent to the slide path, and the locking member is movable between a locked position wherein it extends into the slide path to penetrate a locking cavity defined in the slide member when the slide member is in its engaged position (thereby preventing motion of the slide member into its disengaged position), and an unlocked position outside of the slide path.

The slide member may be slidably constrained with respect to the body by defining a body slot extending between an interior surface of the body and its exterior surface, and by having a portion of the slide member ride within the body slot. Preferably, the slide member bears a protruding handle which is accessible from the exterior surface of the body, and which may be used to actuate the slide member along the slide path. The handle beneficially provides a visible indication to a user as to whether the slide member is in its engaged or disengaged position.

Ejection port gun locks of the foregoing nature can have their bodies and slide members configured to fit the ejection ports of handguns (as illustrated by the exemplary gun lock 100 shown in FIGS. 1–7 of the accompanying drawings, wherein the body 102 is configured to rest outside the ejection port with the slide member 136 fitting therein), or to fit the ejection ports of shotguns or other firearms (as illustrated by the exemplary gun lock 200 shown in FIGS. 8–11 of the accompanying drawings, wherein both the body 202 and the slide member 240 may fit within the ejection port). Additionally, the slide members may be formed as a single piece (as with the slide member 240 of FIGS. 8–11), or in multiple pieces which may be spring-biased with respect to each other to allow them to fit ejection ports of varying size (as with the slide member engagement portion 138 and slide member supplementary portion 140 of FIGS. 1–7).

Further advantages, features, and objects of the invention will be apparent from the following detailed description of the invention in conjunction with the associated drawings.

DETAILED DESCRIPTION OF THE PREFERRED VERSIONS OF THE INVENTION

Figure 1:
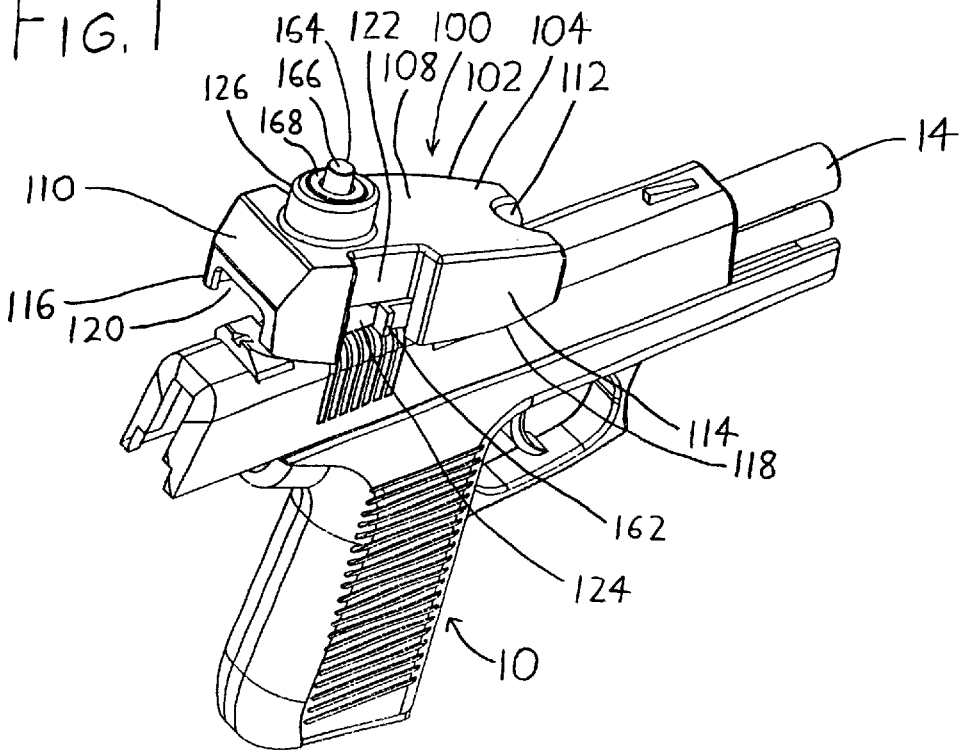
FIG. 1 is a perspective view of an exemplary ejection port gun lock 100 in accordance with the invention, shown in a position immediately prior to installation on a handgun 10.

Referring initially to FIGS. 1–7, a first exemplary version of the invention is generally depicted by the ejection port gun lock shown at the reference numeral 100. The ejection port gun lock 100 is illustrated in conjunction with an exemplary handgun 10 of the top-ejecting type, wherein spent ammunition shells are ejected through an ejection port 12 (best seen in FIG. 2). The general structure of the exemplary ejection port gun lock 100 will now be described, with its function and operation then being discussed afterward.

The ejection port gun lock 100 includes an elongated body 102 which is preferably provided in two portions, a first portion 104 (generally visible in all of FIGS. 1–7) and a second portion 106 (best seen in FIGS. 2–3 and 5–7). As best seen in FIGS. 1–2 and 4–5, the body first portion 104 includes a top surface 108, a rear surface 110 and an opposing front surface 112 wherebetween the length of the body 102 is defined, and opposing side surfaces 114 (best seen in FIGS. 1, 3–4, and 6–7). These side surfaces 114 include descending portions 116 which extend beneath the installed body second portion 106, and which terminate in lower edges 118. The descending portions 116 define concavities 120 situated below the rear surface 110 and front surface 112, with these concavities 120 receiving the top surface of the handgun 10 when the ejection port gun lock 100 is installed on a handgun 10. The side surfaces 114 also include an indented portion 122 which lacks the descending portions 116, thereby defining an access port 124 within the side surfaces 114 of the body first portion 104, and between the descending portions 116. The body first portion 104 also includes a barrel-like locking member receiver 126 which opens onto the interior of the body 102 between its first portion 104 and its second portion 106, and the function of the locking member receiver 126 will also be described later.

Figure 7:
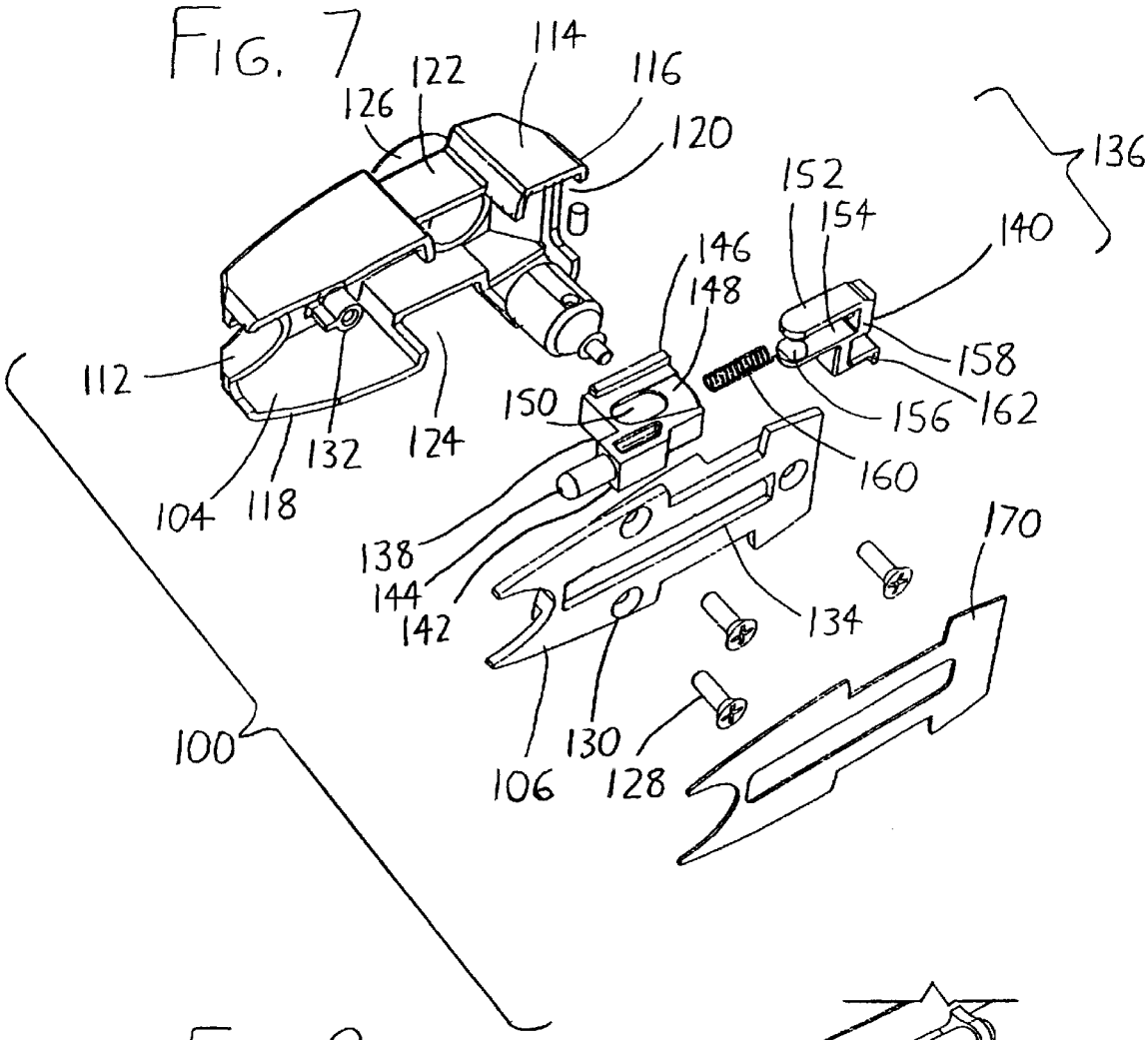
FIG. 7 is an exploded bottom perspective view of the ejection port gun lock 100 of FIGS. 1–6.
Figure 8:
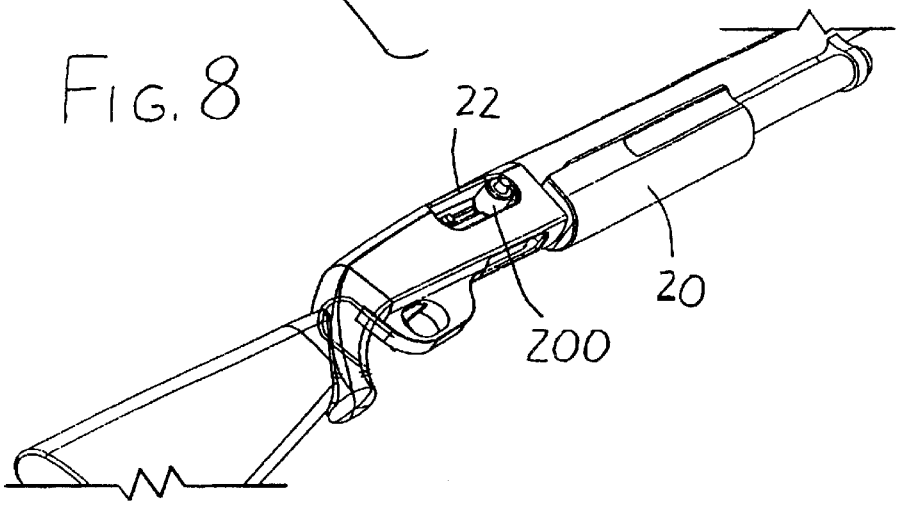
FIG. 8 is a perspective view of an exemplary second version of an ejection port gun lock 200 in accordance with the invention, shown installed within the ejection port 22 of a shotgun 20.
Figure 9:
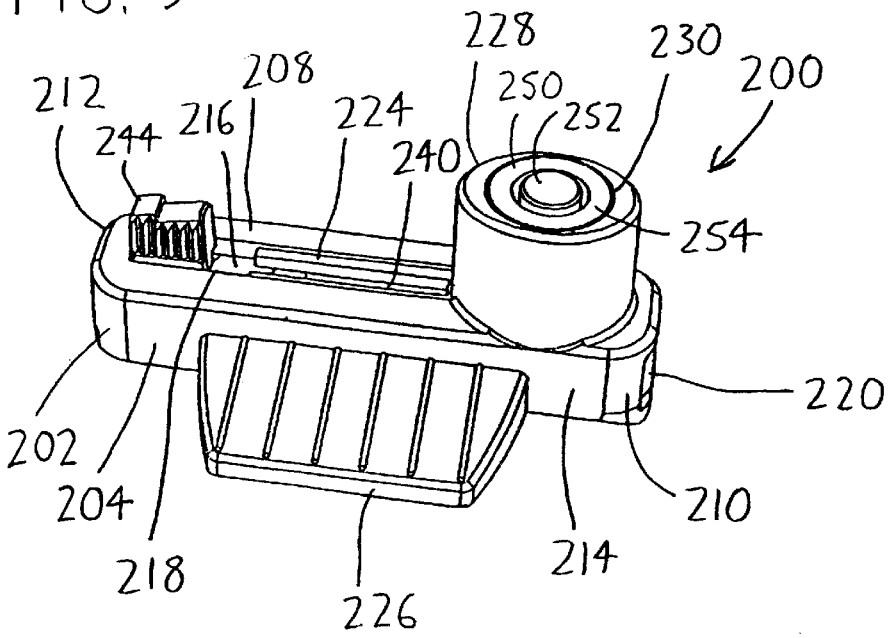
FIG. 9 is a perspective view of the ejection port gun lock 200 of FIG. 8, shown with its slide member 240 in its withdrawn position.

Turning to FIGS. 2–3 and 5–7, it is seen that the second portion 106 of the body 102 is installed below the first portion 104 by fitting it between the descending portions 116. Referring particularly to FIG. 7, the body second portion 106 is removably affixed to the body first portion 104 by use of fasteners 128, or additionally (or alternatively) by a friction or snap-fit or other conventional means of affixment. The fasteners 128 insert through fastener holes 130 in the body second portion 106 to be received within threaded bosses 132 (see FIG. 7) on the body first portion 104. The body second portion 106 has a body slot 134 defined therein, the function of which will be described later in this document.

A slide member 136 is then fit within the body slot 134 of the body 102 (more specifically of the body second portion 106) so that it may move along the body slot 134 between a disengaged position (see particularly FIGS. 2 and 3) and an engaged position (see particularly FIGS. 5 and 6), with the space traversed by the slide member 136 between these positions hereinafter being referred to as the slide path. The slide member 136 is preferably formed in two parts/sections which are best seen in FIG. 7, a engagement portion 138 and a supplementary portion 140. The slide member engagement portion 138 has a lower body 142 with a width sized and configured to allow it to be received within the body slot 134, with the lower body 142 also including an elongated tongue 144 protruding therefrom. The slide member engagement portion 138 additionally has an upper anchor 146 which is sized so that it may not fit through the body slot 134. Therefore, when the lower body 142 of the slide member engagement portion 138 is fit through the body slot 134, with the tongue 144 resting below the body second portion 106 and with the upper anchor 146 resting between the body first portion 104 and body second portion 106, the engagement portion 138 of the slide member 136 is slidably confined within the body slot 134 such that it may move along the body slot 134, but may not be removed from the body 102. An affixment groove 148 is also defined in the slide member engagement portion 138 between its upper anchor 146 and tongue 144 to allow slidable engagement of the slide member engagement portion 138 and slide member supplementary portion 140 in a manner to be described later in this document. The slide member engagement portion 138 additionally has a locking cavity 150 formed on its top surface adjacent the upper anchor 146, with this locking cavity 150 being visible in FIGS. 2 and 5. As will be explained in greater detail later in this document, the locking cavity 150 is used to lock the slide member engagement portion 138 in fixed relation to the body 102.

Looking again to FIG. 7, it is seen that the slide member supplementary portion 140 includes a pair of parallel arms 152 separated by a receiving gap 154, with the arms 152 terminating in a pair of opposing inwardly-directed nubs 156 at one of their ends and a bridge 158 at their other ends. Thus, the slide member supplementary portion 140 is affixed to the slide member engagement portion 138 by receiving the engagement portion lower body 142 within the supplementary portion receiving gap 154, with the nubs 156 of the arms 152 fitting within the affixment groove 148 to affix the slide member supplementary portion 140 to the slide member engagement portion 138, but allowing the slide member supplementary portion 140 to translate with respect to the slide member engagement portion 138 by a limited distance (owing to the ability of the nubs 156 of the arms 152 to travel within the affixment groove 148). A spring 160 is received between the supplementary portion bridge 158 and the engagement portion lower body 142, thereby biasing apart the slide member engagement portion 138 and the slide member supplementary portion 140.

The slide member supplementary portion 140 additionally includes a protruding handle 162 extending laterally from one of the arms 152 (though a pair of handles 162, each laterally extending from one of the arms 152, is a useful alternative approach). When the forward and supplementary portions 138 and 140 of the slide member 136 are assembled in the manner previously described, with the slide member upper anchor 146 situated above the body second portion 106 and the slide member supplementary portion 140 and tongue 144 situated below the body second portion 106 and outside of the body 102, the handle 162 travels through the access port 124 of the body 102 (see particularly FIGS. 1 and 3) when the slide member 136 travels along the slide path (and the body slot 134) between the disengaged portion (see particularly FIG. 3) and the engaged position (see particularly FIG. 6). Thus, a user may manipulate the handle 162 (and thus the body second portion 106) when locking the ejection port gun lock 100 to a handgun 10, as will be discussed later in this document.

Figure 2:
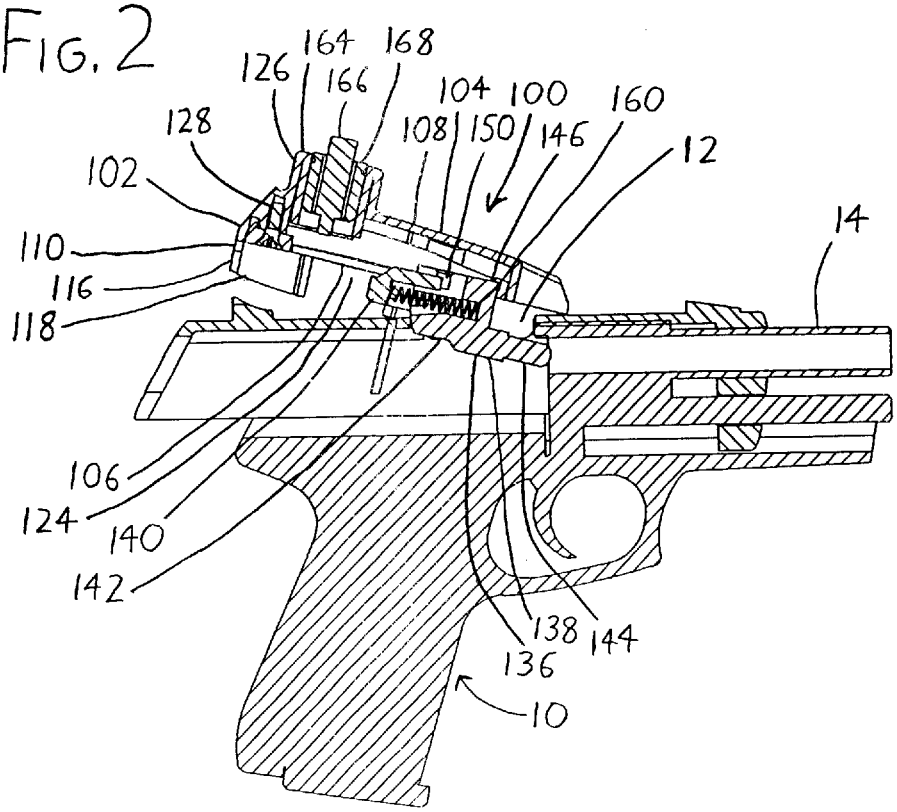
FIG. 2 is a cross-sectional side elevation view of the ejection port gun lock 100 and handgun 10 of FIG. 1.
Figure 3:
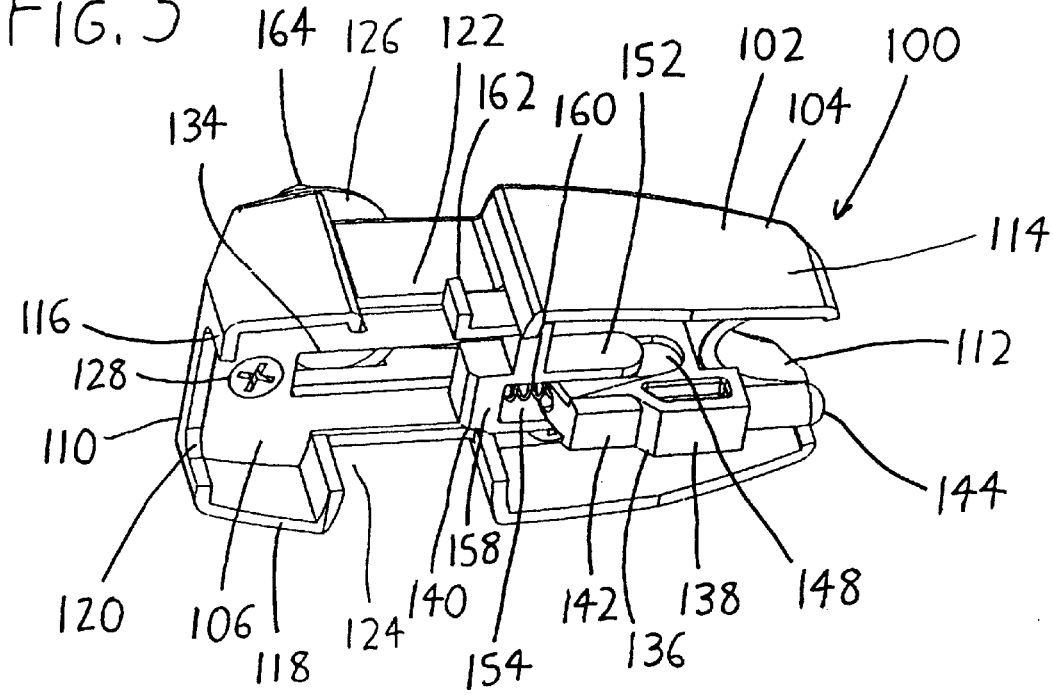
FIG. 3 is a bottom perspective view of the ejection port gun lock 100 of FIGS. 1 and 2.
Figure 4:
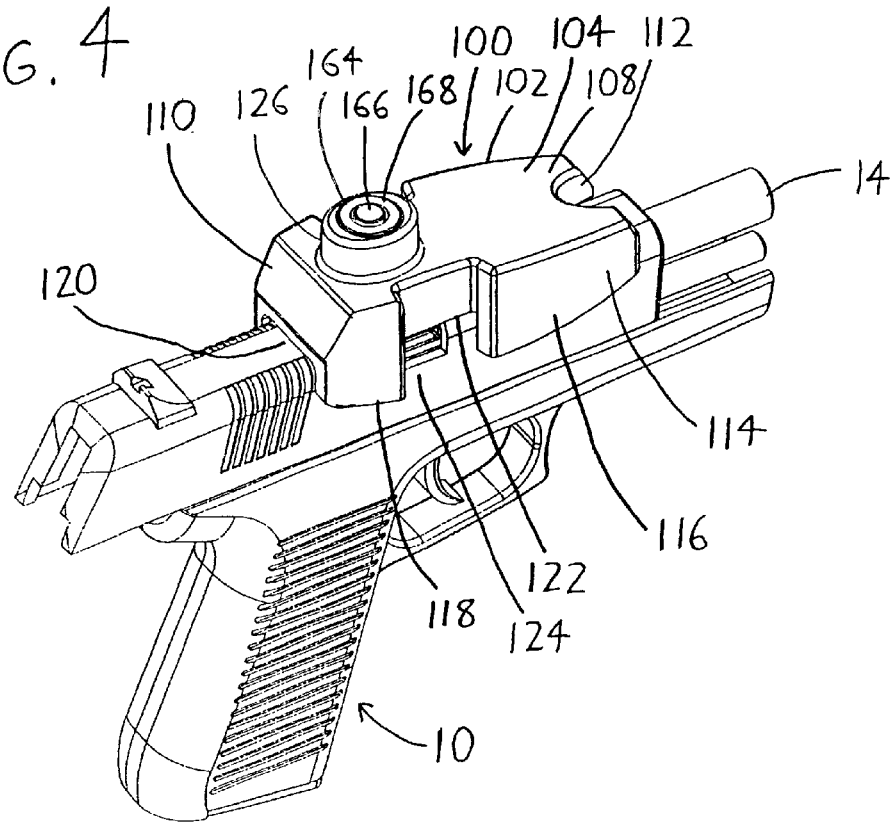
FIG. 4 is a perspective view of the ejection port gun lock 100 of FIGS. 1–3 shown in its installed position on the handgun 10 of FIGS. 1 and 2.
Figure 5:
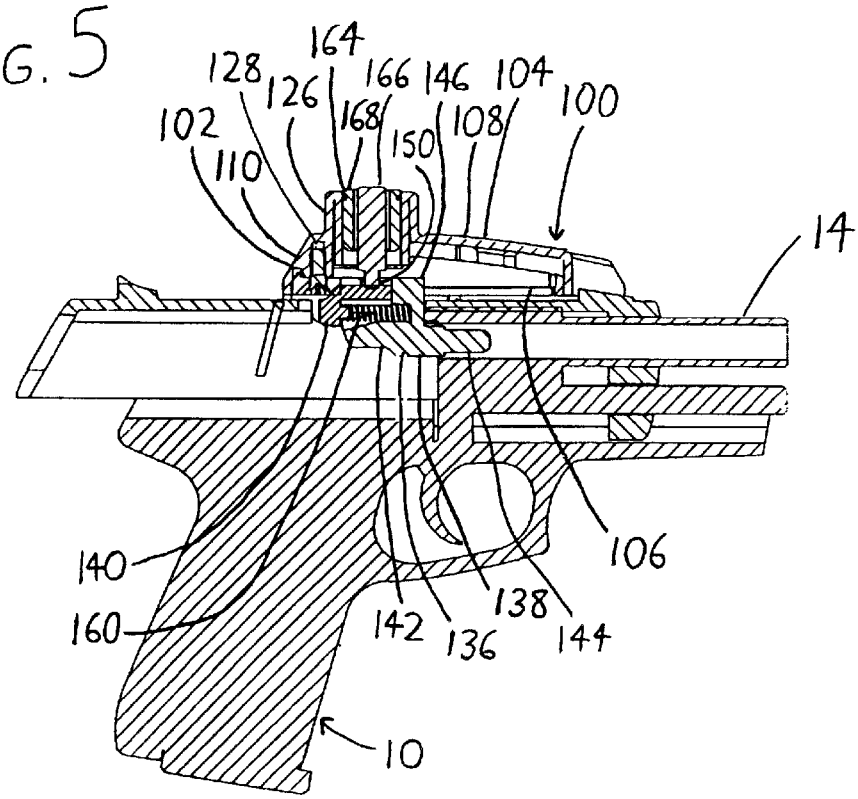
FIG. 5 is a cross-sectional side elevation view of the ejection port gun lock 100 and handgun 10 of FIG. 4.
Figure 6:
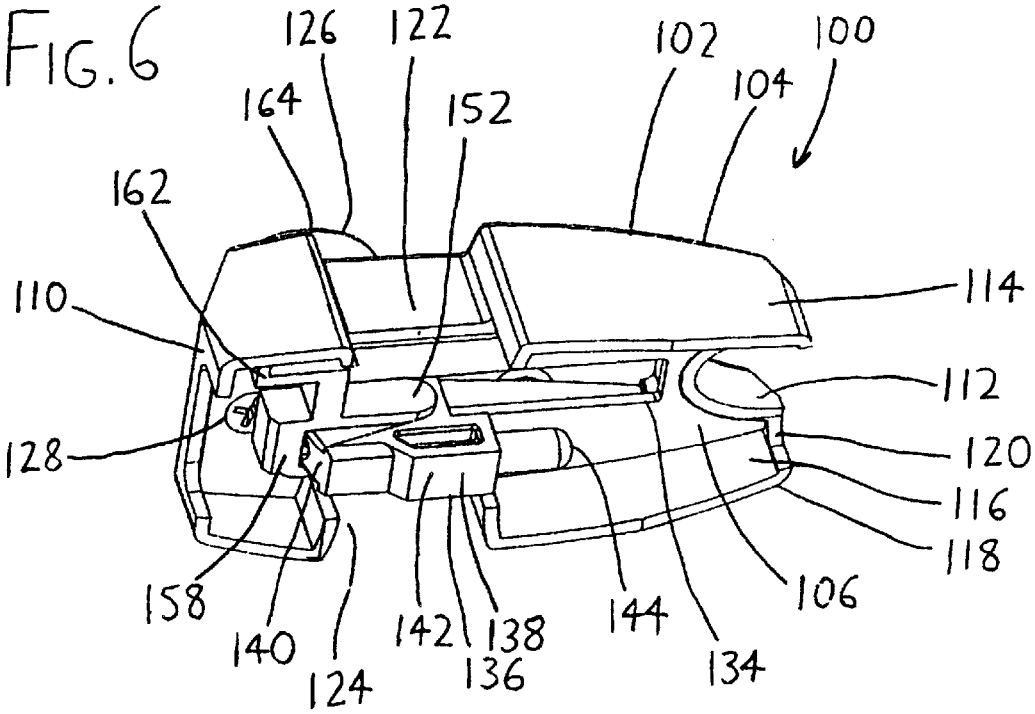
FIG. 6 is a bottom perspective view of the ejection port gun lock 100 of FIGS. 4 and 5.

A locking member 164 is then provided within the locking member receiver 126 of the body first portion 104 in such a manner that the locking member 164 is movable in the body 102 between a locked position wherein the locking member 164 is extended toward the body slot 134 and resting within the slide path of the slide member 136 (see particularly FIG. 5), and an unlocked position distant from the body slot 134 and out of the slide path of the slide member 136 (see particularly FIG. 2). When the slide member 136 is in its engaged position and the locking member 164 is in the locked position, the locking member 164 extends into the locking cavity 150 of the slide member 136, thereby affixing the slide member 136 in place in its locked position along its slide path. Here, the locking member 164 is depicted as a central cylinder 166 maintained within an outer sleeve 168 (the sleeve being received within the locking member receiver 126 of the body first portion 104), with the cylinder 166 being movable within the sleeve 168 between the locked and unlocked positions by depressing the button-like top surface of the cylinder 166 adjacent the top surface 108.

However, it should be understood that this simple form of locking member 164 is depicted merely for illustrative purposes, and the structure of the locking member 164 and the manner in which it is moved between its locked and unlocked positions may vary; for example, the cylinder 166 might be threaded within the sleeve 168, and might include a specially-shaped aperture in the top of the cylinder 166 for receiving a specially-shaped key, whereby actuating the key allows easy rotation of the cylinder 166 between the locked and unlocked positions. Thus, the cylinder 166 would be made resistant to unlocking unless a user had the key. Alternative arrangements for the locking member 164 include tumbler-style locks (using keys, rotary combinations, or other locking features), magnetic induction locks (preferably normally maintaining the locking member 164 in its locked state unless the appropriate current is applied to change the locking member 164 to its unlocked state), or other locking mechanisms.

The operation of the ejection port gun lock 100 will now be described with particular reference to FIGS. 1–6. Looking to FIGS. 1–3, wherein the gun lock 100 is in its unlocked state, the ejection port gun lock 100 is situated above the ejection port 12 of the handgun 10 such that the engagement portion 138 (more specifically its tongue 144) of the slide member 136 is partially fit within the barrel 14 of the gun 10. This operation can be assisted by the user's actuation of the handle 162 of the slide member 136 to move the slide member 136 forwardly, as far as possible into the disengaged position (see particularly FIGS. 2 and 3). The slide member engagement portion 138 will be biased forwardly of the slide member supplementary portion 140 by the spring 160. The user then continues to move the body 102 of the ejection port gun lock 100 forwardly, so that the tongue 144 of the slide member engagement portion 138 continues to insert within the barrel 14 as far as possible, eventually causing the slide member engagement portion 138 to abut the forward edge of the ejection port 12. The user continues to push the body 102 of the ejection port gun lock 100 forwardly, preferably while also continuing to push the handle 162 of the slide member 136 forwardly so that the slide member supplementary portion 140 defeats the spring 160 to move in close relation to the slide member engagement portion 138 (thereby decreasing the effective length of the slide member 136 along the slide path). As the user continues to push the body 102 forwardly on the handgun 10, the slide member 136 moves rearwardly within the slide path and along the body slot 134. Eventually, the slide member 136 will reach its engaged position (see particularly FIGS. 5 and 6), with the locking cavity 150 of the slide member engagement portion 138 situated adjacent the locking member 164. The locking member 164 may then be depressed to move the locking member 164 from its unlocked position (see particularly FIGS. 1–2) to its locked position (see particularly FIGS. 5–6), wherein the cylinder 166 moves into the locking cavity 150. The user may then release the handle 162 so that the spring 160 biases the slide member supplementary portion 140 rearwardly from the slide member engagement portion 138 along the slide path to engage the rear edge of the ejection port 12. As a result, the slide member 136 is fixed in the engaged position with the tongue 144 of the engagement portion 138 within the ejection port 12 and barrel 14, and the body 102 is moved so far forwardly on the gun 10 in parallel relation to the tongue 144 that the gun lock 100 may no longer be removed from the ejection port 12 and barrel 14 without experiencing interference between the gun 10 and the tongue 144 and/or the body 102.

It is noted that when the slide member 136 is fixed in the engaged position with its engagement portion 138 held by the locking member 164, the slide member supplementary portion 140 does not significantly participate in preventing removal of the body 102 from the gun 10; rather, prevention of removal is done owing to the close parallel spacing of the body 102 and the tongue 144 of the slide member engagement portion 138 about the barrel 14. However, the spring-biasing of the slide member supplementary portion 140 with respect to the slide member engagement portion 138 helps to more securely engage the slide member 136 within the ejection port 12 to minimize slippage of the gun lock 100 on the gun 10. Stated differently, the spring-biased slide member supplementary portion 140 is not essential to the gun lock 100, and the slide member engagement portion 138 alone could be used to maintain the gun lock 100 on the gun 10. However, without the use of the spring-biased slide member supplementary portion 140 to expand the size of the slide member 136 to (preferably) extend between the forward and rear edges of the ejection port 12, the gun lock 100 may "rattle" on the gun 10 and damage its finish. It is also useful to include a compressible pad 170 (such as a pad made of rubber or other elastomeric metarials) on the body second portion 106 where the body second portion 106 abuts the outer surface of the handgun 10, so that the pad 170 also helping prevent scuffing or other damage to the finish of the handgun 10.

Once the gun lock 100 is secure on the gun 10, the gun 10 cannot be located or discharged since (1) the body effectively blocks the ejection port 12, (2) the tongue 144 protrudes into the barrel 14, and (3) the body 102 prevents a live round of ammunition from being fed into the breech. Since the slide member 136 (more) particularly its tonge 144) and body 102 provide two generally parallel, closely spaced structures which maintain the walls of the ejection port 12 therebetween, the body 102 cannot be rotated to remove the slide member 136 the ejection port 12 without interference. The descending portions 116 of the side surfaces 114 if of the body 102 reduce potential points of leverage in the event that someone attempts to forceably remove the lock 100.

The component sizes of the gun lock 100 can be adjusted to fit a wide range of firearms designs, though the design described above adapts to the vast majority of firearms available. In effect, the gun lock 100 has a "universal" design insofar as it accommodates the vast majority of top-loading handguns. Additionally, the configuration of the gun lock 100 can be altered to adapt it to fit the ejection ports of shotguns or other firearms as well, though the gun lock 100 would need to be made in a wider variety of sizes and configurations for use with shotguns owing to the greater variety in shotgun port sizes and configurations. To illustrate, the tongue 144 may be lengthened, and the shape of the body 102 may be altered (by eliminating the descending portions 116 or via other alterations), to adapt the gun lock 100 to fit the ejection port of a shotgun. It is also possible to adapt the gun lock 100 so that the body 102 need not rest outside the shotgun's ejection port, and instead the body 102 can fit entirely within the ejection port.

These modifications are in part illustrated in FIGS. 8–11, wherein a second version of an ejection port gun lock in accordance with the invention is depicted by the reference numeral 200. The ejection port gun lock 200 is specially adapted for use within the ejection port of a shotgun, such as the exemplary shotgun 20 of FIG. 8. The gun lock 200 has a body 202 which is preferably formed in two portions, a first portion 204 and a second portion 206. The body first portion 204 has a top surface 208, an opposing bottom surface (not shown), a front surface 210, an opposing rear surface 212, and opposing side surfaces 214 extending between the front and rear surfaces 210 and 212. The body first portion 204 is largely hollow, with an interior passage 216 extending along the greater portion of the length of the body first portion 204 between its front surface 210 and rear surface 212. The passage 216 opens onto the top surface 208 along a body slot 218, and additionally on the front surface 210 at a slide member port 220, and on the bottom surface at a bottom aperture 222 which extends along the majority of the length of the interior passage 216. A pair of rails 224 are adjacently situated along opposing sides of the body slot 218 along a major portion of its length. An interference member 226 preferably extends from one of the side surfaces 214 of the body first portion 204 for purposes to be discussed later in this document (though the interference member 226 might extend from the body second portion 206 instead). A barrel-like locking member receiver 228 is situated on the top surface 208 of the body first portion 204, preferably near the front surface 210 adjacent to the slide member port 220, and it includes an internal locking member bore 230 which opens onto the interior passage 216.

The body second portion 206 is formed as an elongated plate configured to fit across the bottom surface of the body first portion 204 and be affixed thereon via insertion of a fastener 232 through hole 234, with the fastener 232 then penetrating the bottom surface of the body first portion 204 near its rear surface 212. The body second portion 206 thereby serves to close the bottom aperture 222 in the body first portion 204 to close the body 202 and prevent the removal of a slide member 240 (to be discussed below) from the body interior passage 216. If desired, the body second portion 206 may include a butt 236 (shown only in FIG. 11) which protrudes beyond the rear surface 212 of the body first portion 204 to effectively lengthen the body 202 to accommodate larger shotgun ejection ports 22 (e.g., with magnum caliber guns and the like). Thus, the effective size of the body 202 may be adapted by simply choosing a body second portion 206 having an appropriately sized butt 236. A locking aperture 238 is preferably also defined in the body second portion 206 (and is shown only in FIG. 11), with the locking aperture 238 being coaxially aligned with the locking member bore 230 in the body first portion 204 for reasons to be discussed later in this document.

Figure 10:
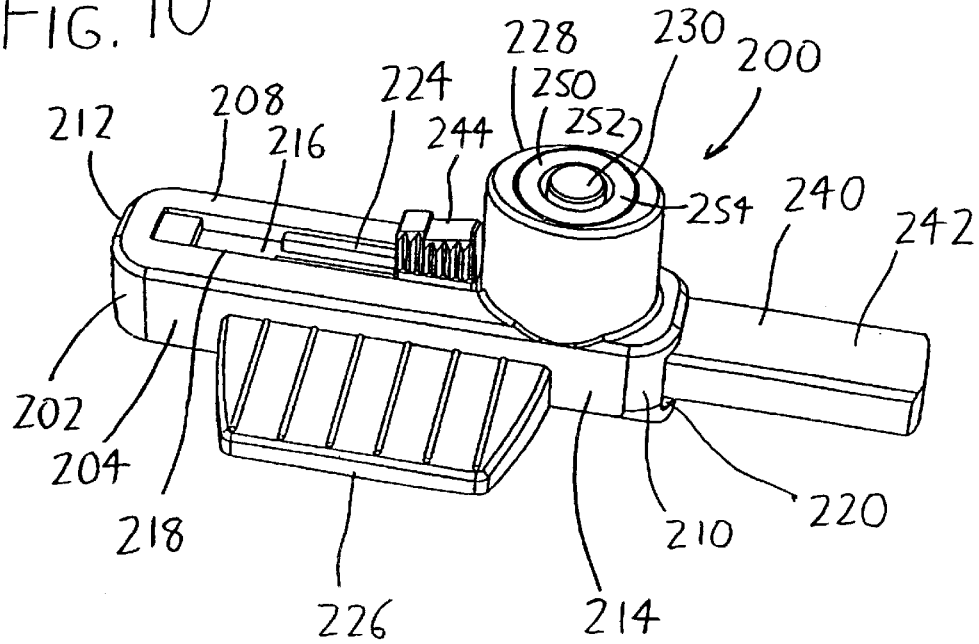
FIG. 10 is a perspective view of the ejection port gun lock 200 of FIGS. 8 and 9 showing the slide member 240 in its engaged position.
Figure 11:
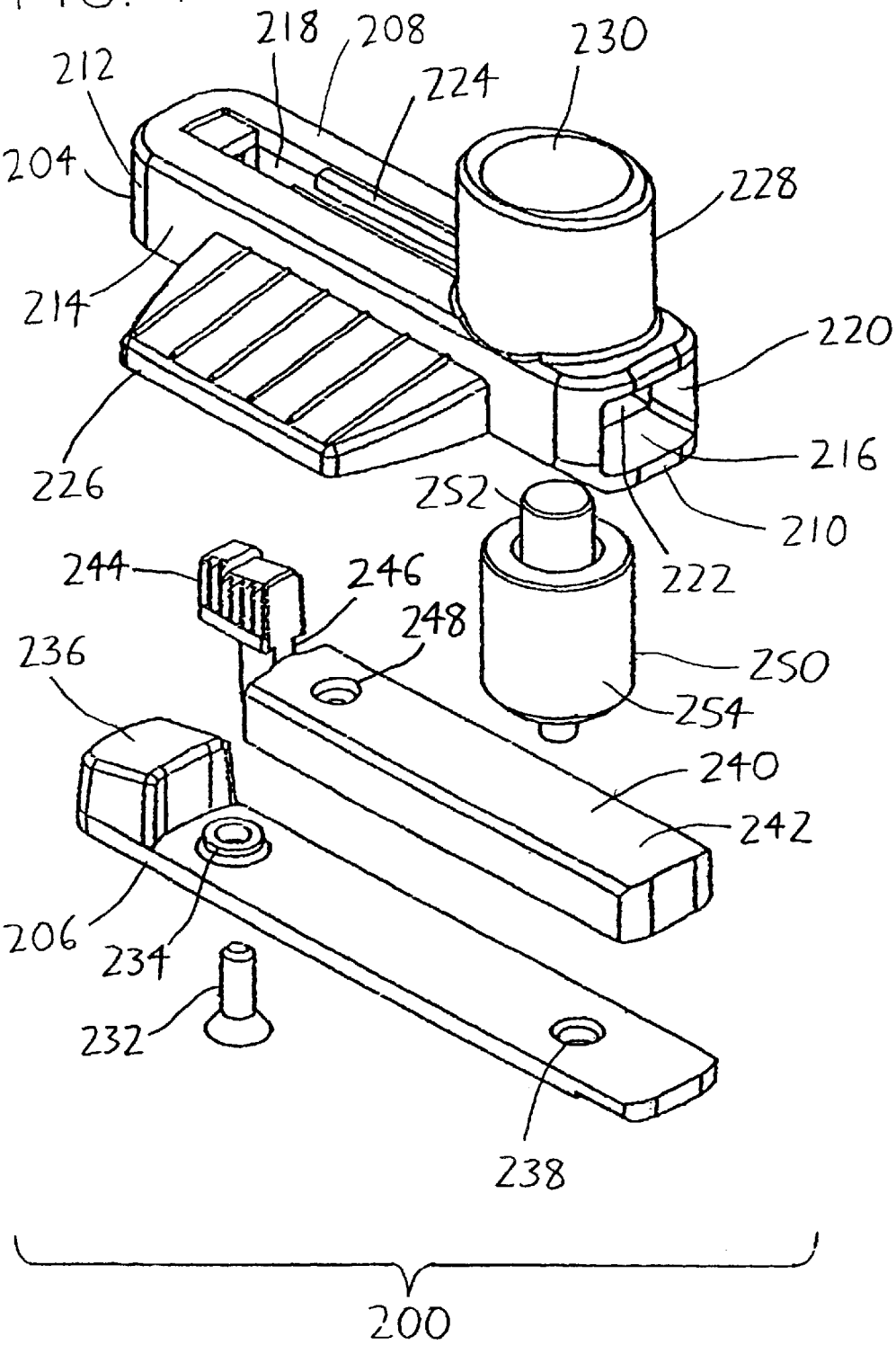
FIG. 11 is an exploded perspective view of the ejection port gun lock 200 of FIGS. 8–10, shown with an extension member 236 for adapting the ejection port gun lock 200 to differently-sized ejection ports.

The slide member 240 is then configured to complimentarily fit within the interior passage 216 in the body 202, and move therein along a slide path between a disengaged position (see FIG. 9) and an engaged position (see FIG. 10). The slide member 240 has an engagement portion 242, and a protruding handle 244 having a narrowed bridge 246 which spaces the handle 244 from the engagement portion 242 of the slide member 240. As a result, when the body 202 is being assembled, the engagement portion 242 may be inserted within the bottom aperture 222 in the body first portion 204 so that the engagement portion 242 protrudes from the slide member port 220 in the front surface 210, and the handle 244 of the slide member 240 extends through the body slot 218 (by fitting it through the portion of the body slot 218 which excludes rails 224) to rest above the top surface 208 of the body 202. The body second portion 206 may then be installed on the body first portion 204 to slidably confine the engagement portion 242 of the slide member 240 within the interior passage 216 in the body 202 so that it can move along the body slot 218 between the disengaged position (FIG. 9) and the engaged position (FIG. 10), with the path traversed by the slide member 240 defining the slide path. The engagement portion 242 of the slide member 240 additionally has a locking cavity 248 defined therein, having a purpose which will be discussed shortly. The locking cavity 248 is preferably situated near the handle 244, which will be adjacent to the slide member port 220 and locking member receiver 228 when the slide member 240 is extended into its engaged position.

A locking member 250 is then provided within the locking member receiver 228 so that it may move between a locked position where it extends into the body interior passage 216 and the slide path, and an unlocked position wherein it is not situated within the slide path. Again, the locking member 250 is shown as a cylinder 252 which translates within a sleeve 254. When the slide member 240 is extended into its engaged position, the locking member 250 (more specifically its cylinder 252) extends from the body first portion 204, through the locking cavity 248 of the engagement portion 242, and into the locking aperture 238 of the body second portion 206, thereby firmly pinning the engagement portion 242 of the slide member 240 between the body first portion 204 and body second portion 206. However, it is also possible to have the cylinder 252 extend only so far enough into the slide path that the locking cavity 248 of the engagement portion 242 is engaged, but the cylinder 252 does not so fully penetrate the engagement portion 242 that it also enters the body second portion 206.

In operation, the ejection port gun lock 200 deters the unauthorized use of a shotgun by preventing the chambering/loading of ammunition. The handle 244 is actuated to move the slide member 240 to its disengaged position (FIG. 9), wherein the engagement portion 242 is withdrawn as far as possible along the slide path into the interior of the body 202. The body 202 is then inserted into the ejection port 22 of the shotgun 20 so that the interference member 226 extends into the shotgun 20's loading port. The handle 244 is then actuated to move the slide member 240 into its engaged position, with the engagement portion 242 extending from the slide member port 220. Once the slide member 240 is in its engaged position, the cylinder 252 of the locking member 250 may be depressed into its locked position wherein it extends into the slide path, and into the locking cavity 248 of the engagement portion 242 (and the locking aperture 238 of the body second portion 206, if provided), preventing the slide member 240 from being dislodged from its engaged position. Thus, the gun lock 200 prevents firing of the shotgun 20 because the body 202 blocks the ejection port 22, the engagement portion 242 of the slide member 240 extends into the barrel, and the interference member 226 extends into the loading port of the shotgun 20.

The illustrated gun lock 200 fits the vast majority of side-loading pump and semiautomatic shotguns in 10, 12, 16 and 20 gauge calibers and a wide variety of gauge lengths. It can also be adapted for use in handguns, such as the handgun 10, if the body 202 is sized to fit within the ejection port 12 (such that the body 12 cannot be removed from the ejection port 12 when the engagement portion 242 is extended into its engaged position), and if the interference member 226 is removed.

A significant advantage of both of the gun locks 100 and 200 is that the handles 162 and 244 provide a visible indication of whether the locks 100 and 200 are in their engaged or disengaged states after being installed on a gun (and similarly the cylinders 166 and 252 provide a visible indication of whether or not the locking members 164 and 250 are in their locked or unlocked positions). This avoids a problem present in some prior art gun locks where the gun locks are placed in a locked state solely by use of a key or the like, and there is no externally visible indication of whether the locks are engaged or not. Thus, a user is less likely to leave the gun locks 100 and 200 in an unlocked state under the misimpression that they are actually in a locked state.

It is understood that preferred versions of the invention are shown in the drawings and described above simply to illustrate possible features of the invention and the varying ways in which these features may be combined. The invention is not intended to be limited to the preferred versions of the invention described above, but rather is intended to be limited only by the claims set out below. Thus, the invention encompasses all different versions that fall literally or equivalently within the scope of these claims.

What is claimed is:

1. An ejection port gun lock comprising:

a. a body including a body locking aperture defined therein;

b. a slide member slidably engaged within the body to move along a slide path between a disengaged position and an engaged position, the slide member having a locking cavity defined therein which extends through the slide member, wherein the locking cavity is aligned with the body locking aperture when the slide member is in its engaged position;

c. a locking member provided in the body, the locking member being movable between a locked position extending within the slide path, and an unlocked position;

whereby:

(1) the gun lock may be at least partially fit within the ejection port of a gun, (2) the slide member may subsequently be moved into its engaged position within the ejection port to restrain the body from withdrawal from the ejection port, and (3) the locking member may subsequently be moved into its locked position, wherein the locking member extends from the body, through the locking cavity of the slide member, and into the body locking aperture to prevent motion of the slide member into its disengaged position.

2. The ejection port gun lock of claim 1 wherein:

a. the body also has an exterior surface through which a body slot is defined, the body slot partially defining the slide path along which the slide member travels, and b. the slide member has a protruding handle suitable for user actuation of the slide member.

3. The ejection port gun lock of claim 1 wherein:

a. the slide path is at least partially defined by:

i. a passage within the body wherein the slide member is complementarily fit, and ii. a body slot defined within the body, the body slot opening onto the passage;

b. the slide member has a handle protruding therefrom, the handle extending through the body slot.

4. The ejection port gun lock of claim 1 wherein:

a. the slide member is withdrawn within the body when in its disengaged position, and is extended from the body when in its engaged position; and b. the slide member has opposing sides which both rest adjacent the body when the slide member is in its engaged position.

5. The ejection port gun lock of claim 1 wherein:

a. the body includes first and second body portions joined to define the body, b. the locking member, when moved into its locked position, extends from one body portion to the other.

6. The ejection port gun lock of claim 5 wherein the slide path along which the slide member moves is situated between the first and second body portions.

7. An ejection port gun lock comprising:

a. a body;

b. a slide member slidably engaged within the body to move along a slide path between a disengaged position and an engaged position, the slide member including:

(1) a locking cavity defined therein, (2) an engagement portion including an elongated tongue protruding therefrom in a direction at least substantially parallel to the slide path, and (3) a supplementary portion situated adjacent the engagement portion along the slide path; with the engagement and supplementary portions being elastically biased apart;

c. a locking member provided in the body, the locking member being movable between a locked position extending within the slide path, and an unlocked position;

whereby:

(1) the gun lock may be at least partially fit within the ejection port of a gun, (2) the slide member may subsequently be moved into its engaged position within the ejection port to restrain the body from withdrawal from the ejection port, and (3) the locking member may subsequently be moved into its locked position and at least partially into the locking cavity to prevent motion of the slide member into its disengaged position.

8. The ejection port gun lock of claim 7 wherein the supplementary portion includes a handle protruding therefrom, whereby the handle may be actuated to selectively defeat the elastic biasing between the engagement and supplementary portions.

9. The ejection port gun lock of claim 7 wherein the locking cavity is defined in the engagement portion.

10. The ejection port gun lock of claim 7 wherein the engagement and supplementary portions are elastically biased apart along a direction oriented at least substantially parallel to the slide path.

11. The ejection port gun lock of claim 10 wherein the supplementary portion includes a protruding handle suitable for user actuation of the slide member.

12. The ejection port gun lock of claim 11 wherein:

a. the body includes descending portions which curve downwardly and away from the slide path to terminate in a lower edge;

b. an access port is defined in the descending portions, and c. the handle travels through the access port as the slide member moves between its disengaged position and its engaged position.

13. The ejection port gun lock of claim 7 wherein the slide path includes a body slot extending through the body, and wherein the body extends away from and curves downwardly from the body slot.

14. The ejection port gun lock of claim 7 wherein the elongated tongue is spaced from the body.

15. The ejection port gun lock of claim 14 wherein the body includes opposing descending portions which curve downwardly and away from the slide path on opposing sides of the tongue.

16. An ejection port gun lock comprising:

a. a body;

b. a slide member slidably engaged within the body to move along a slide path between a disengaged position and an engaged position, the slide member including an engagement portion and a supplementary portion, and wherein the engagement and supplementary portions are elastically biased apart along a direction oriented at least substantially parallel to the slide path;

c. a locking member provided in the body, the locking member being movable between a locked position extending within the slide path, and an unlocked position;

whereby:

(1) the gun lock may be at least partially fit within the ejection port of a gun, (2) the slide member may subsequently be moved into its engaged position within the ejection port to restrain the body from withdrawal from the ejection port, and (3) the locking member may subsequently be moved into its locked position to prevent motion of the slide member into its disengaged position.

17. The ejection port gun lock of claim 16 wherein:

a. the body also has an exterior surface through which a body slot is defined, the body slot partially defining the slide path along which the slide member travels, and b. the slide member has a protruding handle suitable for user actuation of the slide member.

18. The ejection port gun lock of claim 16 wherein:

a. the slide member has a locking cavity defined therein, and b. when the slide member is in its engaged position and the locking member is situated in its locked position extending within the slide path, the locking member extends at least partially into the locking cavity.

19. The ejection port-gun lock of claim 16 wherein:

a. the engagement and supplementary portions are adjacently situated along the slide path, and b. the engagement portion includes an elongated tongue protruding therefrom in a direction at least substantially parallel to the slide path.

20. The ejection port gun lock of claim 19 wherein the supplementary portion includes a handle protruding therefrom, whereby the handle may be actuated to selectively defeat the elastic biasing between the engagement and supplementary portions.

21. The ejection port gun lock of claim 19 wherein the locking cavity is defined in the engagement portion.

22. The ejection port gun lock of claim 16 wherein the engagement portion includes a protruding tongue extending at least substantially parallel to the direction of the slide path.

23. The ejection port gun lock of claim 16 wherein the supplementary portion includes a protruding handle suitable for user actuation of the slide member.

24. The ejection port gun lock of claim 23 wherein:

a. the body includes descending portions which curve downwardly and away from the slide path to terminate in a lower edge;

b. an access port is defined in the descending portions, and c. the handle travels through the access port as the slide member moves between its disengaged position and its engaged position.

25. The ejection port gun lock of claim 16 wherein the slide path includes a body slot extending through the body, and wherein the body extends away from and curves downwardly from the body slot.

26. The ejection port gun lock of claim 16 wherein the slide member includes an elongated tongue extending therefrom, the tongue being spaced from the body and oriented at least substantially parallel to the slide path.

27. The ejection port gun lock of claim 26 wherein the body includes opposing descending portions which curve downwardly and away from the slide path on opposing sides of the tongue.

28. An ejection port gun lock comprising:

a. a body;

b. a slide member slidably engaged within the body to move along a slide path between a disengaged position and an engaged position, the slide path being at least partially defined by:

i. a passage within the body wherein the slide member is complementarily fit, and ii. a body slot defined within the body, the body slot opening onto the passage, and wherein the slide member has a handle protruding therefrom, the handle extending through the body slot;

c. a locking member provided in the body, the locking member being movable between a locked position extending within the slide path, and an unlocked position;

whereby:

(1) the gun lock may be at least partially fit within the ejection port of a gun, (2) the slide member may subsequently be moved into its engaged position within the ejection port to restrain the body from withdrawal from the ejection port, and (3) the locking member may subsequently be moved into its locked position to prevent motion of the slide member into its disengaged position.

29. The ejection port gun lock of claim 28 wherein:

a. the slide member has a locking cavity defined therein, and b. when the slide member is in its engaged position and the locking member is situated in its locked position extending within the slide path, the locking member extends at least partially into the locking cavity.

30. The ejection port gun lock of claim 29 wherein:

a. the locking cavity is provided in the form of an aperture extending through the slide member, and b. the body includes a body locking aperture aligned with the locking cavity when the slide member is in its engaged position, whereby the locking member may extend from the body, through the slide member, and then into the body locking aperture.

31. The ejection port gun lock of claim 28 wherein:

a. the slide member is withdrawn within the body when in its disengaged position, and is extended from the body when in its engaged position;

b. the slide member has opposing sides which both rest adjacent the body when the slide member is in its engaged position;

c. the locking member extends from the body, through the opposing sides of the slide member, and then reenters the body when the locking member is in its locked position.

32. The ejection port gun lock of claim 28 wherein:

a. the body includes first and second body portions joined to define the body, b. the locking member, when moved into its locked position, extends from one body portion to the other.

33. The ejection port gun lock of claim 32 wherein the slide path along which the slide member moves is situated between the first and second body portions.

34. An ejection port gun lock comprising:

a. a body;

b. a slide member slidably engaged within the body to move along a slide path between:

i. a disengaged position wherein the slide member is withdrawn within the body, and ii. an engaged position wherein the slide member is extended from the body, and wherein the slide member has opposing sides which both rest adjacent the body when the slide member is in its engaged position;

c. a locking member provided in the body, the locking member being movable between:

i. an unlocked position, and ii. a locked position wherein the locking member extends within the slide path from the body, through the opposing sides of the slide member, and then reenters the body;

whereby:

(1) the gun lock may be at least partially fit within the ejection port of a gun, (2) the slide member may subsequently be moved into its engaged position within the ejection port to restrain the body from withdrawal from the ejection port, and (3) the locking member may subsequently be moved into its locked position to prevent motion of the slide member into its disengaged position.

35. The ejection port gun lock of claim 34 wherein:

a. the body also has an exterior surface through which a body slot is defined, the body slot partially defining the slide path along which the slide member travels, and b. the slide member has a protruding handle suitable for user actuation of the slide member.

36. The ejection port gun lock of claim 34 wherein:

a. the slide member has a locking cavity defined therein, and b. when the slide member is in its engaged position and the locking member is situated in its locked position extending within the slide path, the locking member extends at least partially into the locking cavity.

37. The ejection port gun lock of claim 36 wherein:

a. the locking cavity is provided in the form of an aperture extending through the slide member, and b. the body includes a body locking aperture aligned with the locking cavity when the slide member is in its engaged position, wereby the locking member may extend from the body, through the slide member, and then into the body locking aperture.

38. The ejection port gun lock of claim 34 wherein:

a. the slide path is at least partially defined by:

i. a passage within the body wherein the slide member is complementarily fit, and ii. a body slot defined within the body, the body slot opening onto the passage;

b. the slide member has a handle protruding therefrom, the handle extending through the body slot.

39. The ejection port gun lock of claim 34 wherein:

a. the body includes first and second body portions joined to define the body, b. the locking member, when moved into its locked position, extends from one body portion to the other.

40. The ejection port gun lock of claim 39 wherein the slide path along which the slide member moves is situated between the first and second body portions.

41. An ejection port gun lock comprising:

a. a body defined by joined first and second body portions;

b. a slide member slidably engaged within the body to move along a slide path between a disengaged position and an engaged position;

c. a locking member provided in the body, the locking member being movable between:

i. an unlocked position, and ii. a locked position extending within the slide path, wherein the body extends from one body portion to the other;

hereby:

(1) the gun lock may be at least partially fit within the ejection port of a gun, (2) the slide member may subsequently be moved into its engaged position within the ejection port to restrain the body from withdrawal from the ejection port, and (3) the locking member may subsequently be moved into its locked position to prevent motion of the slide member into its disengaged position.

42. The ejection port gun lock of claim 41 wherein:

a. the body also has an exterior surface through which a body slot is defined, the body slot partially defining the slide path along which the slide member travels, and b. the slide member has a protruding handle suitable for user actuation of the slide member.

43. The ejection port gun lock of claim 41 wherein:

a. the slide member has a locking cavity defined therein, and b. when the slide member is in its engaged position and the locking member is situated in its locked position extending within the slide path, the locking member extends at least partially into the locking cavity.

44. The ejection port gun lock of claim 43 wherein:

a. the locking cavity is provided in the form of an aperture extending through the slide member, and b. the body includes a body locking aperture aligned with the locking cavity when the slide member is in its engaged position, whereby the locking member may extend from the body, through the slide member, and then into the body locking aperture.

45. The ejection port gun lock of claim 41 wherein:

a. the slide path is at least partially defined by:

i. a passage within the body wherein the slide member is complementarily fit, and ii. a body slot defined within the body, the body slot opening onto the passage;

b. the slide member has a handle protruding therefrom, the handle extending through the body slot.

46. The ejection port gun lock of claim 41 wherein:

a. the slide member is withdrawn within the body when in its disengaged position, and is extended from the body when in is engaged position;

b. slide member has opposing sides which both rest adjacent the body when the slide member is in its engaged position;

c. the locking member extended from the body, through the opposing sides of the slide member, and then reenters the body when the locking member is in its locked position.

47. The ejection port gun lock of claim 46 wherein the slide path along which the slide member moves is situated between the first and second body portions.

* * * * *